US005521577A

United States Patent [19]

Mazzochette

[11] Patent Number: 5,521,577

[45] Date of Patent: May 28, 1996

[54] LOW PROFILE RESISTOR

[75] Inventor: Jospeh B. Mazzochette, Cherry Hill, N.J.

[73] Assignee: EMC Technology Inc., Cherry Hill, N.J.

[21] Appl. No.: 523,073

[22] Filed: Sep. 1, 1995

[51] Int. Cl.[6] ..... H01C 1/012

[52] U.S. Cl. ..... 338/312; 338/308; 338/314

[58] Field of Search ..... 338/28, 30, 271, 338/306–308, 310, 312, 314, 332, 22 R; 29/612

[56] References Cited

U.S. PATENT DOCUMENTS 3,832,671 8/1974 Kohima ..... 338/188
4,318,073 3/1982 Rossler, Jr. et al. ..... 338/28

*Primary Examiner*—Tu Hoang
*Attorney, Agent, or Firm*—Donald S. Cohen

[57] ABSTRACT

A low profile load resistor includes a base plate of an electrically conductive material having a pair of opposed flat surfaces and a hole therethrough. A chip resistor is mounted on one of the surfaces of the base plate. The chip resistor includes a substrate of an electrical insulating material having a pair of opposed flat surfaces and a hole therethrough which is aligned with the hole in the base plate. A resistance film is on one of the surfaces of the substrate and has termination films at opposite ends thereof. A termination tab is electrically connected to one of the termination films and extends through the holes in the substrate and base plate. The other termination film is electrically connected to the base plate. A cover plate of an electrical insulating material is over the resistor film and is mechanically connected to the substrate.

12 Claims, 2 Drawing Sheets

LOW PROFILE RESISTOR

FIELD OF THE INVENTION

The present invention is directed to a load resistor, and, more particularly, a load resistor which is small, compact and has a low profile.

BACKGROUND OF THE INVENTION

Load resistors are common elements used in signal processing components and systems. These resistors are used to absorb excess energy. The qualities of a load resistor include the efficiency, average and peak power dissipation, frequency response, performance when exposed to a variety of environmental conditions, size and weight. Such load resistors are typically used as terminations for switches, isolators, circulators, detectors and couplers. Such a load resistor must not only be capable of performing its electrical requirements, but the assembly must be small, compact, of low profile, sealed against damage from the environment, and be capable of being easily mounted on and connected to the device with which it is to be used.

SUMMARY OF THE INVENTION

A load resistor including a base plate of an electrically conductive material having a pair of opposed surfaces and a hole therethrough. A chip resistor is mounted on one of the surfaces of the base plate. The chip resistor includes a substrate of an electrical insulating material having opposed surfaces and an opening therethrough. A resistor film is on one of the surfaces of the substrate and has a pair of ends. A terminal tab is electrically connected to one of the ends of the resistor film and extends through the holes in the substrate and base plate. Means is provided which electrically connects the other end of the resistor film to the base plate.

DETAILED DESCRIPTION

Figure 1:
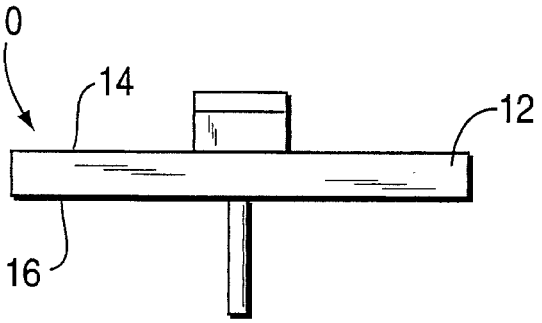
FIG. 1 is a side view of one form of the low profile resistor of the present invention.
Figure 2:
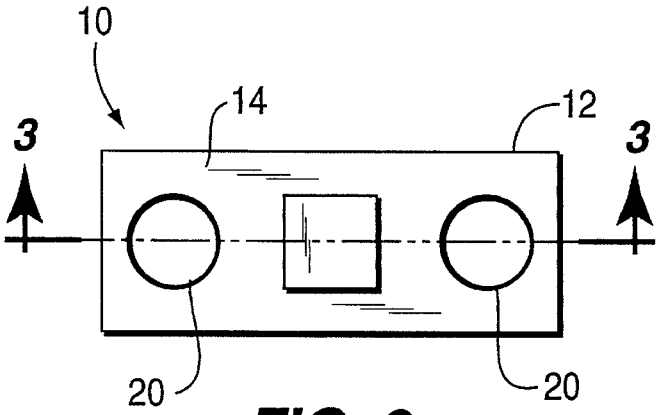
FIG. 2 is a top view of the resistor shown in FIG. 1.
Figure 3:
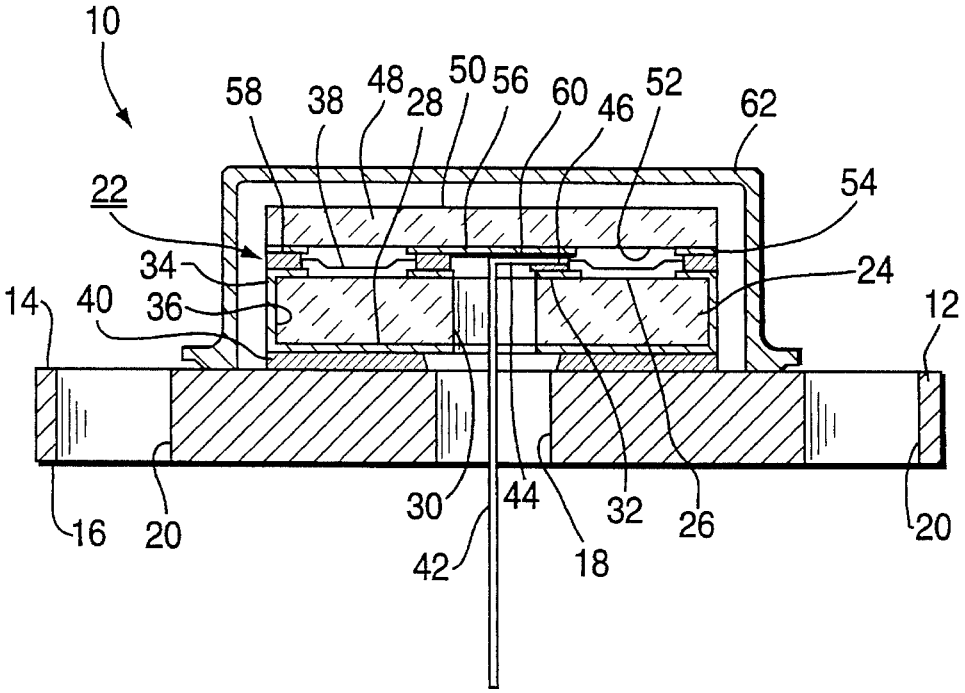
FIG. 3 is a sectional view taken along line 3—3 of FIG. 2.

Referring initially to FIGS. 1, 2 and 3, one form of the low profile resistor of the present invention is generally designated as 10. Resistor 10 comprises a mounting plate 12 of an electrically conductive material, such as a metal, having first and second opposed flat surfaces 14 and 16. Although the base plate 12 is shown in FIG. 2 as being rectangular, it can be of any desired shaped. As shown in FIG. 3, the base plate 12 has a central hole 18 therethrough, and as shown in FIG. 2, has a pair of mounting holes 20 therethrough at opposite sides of the central hole 18. Although the mounting plate 12 is shown as having two mounting holes 20, it can have more than two such mounting holes if desired.

A chip resistor 22 is mounted on the first surface 14 of the base plate 12. Chip resistor 22 comprises a substrate 24 of an electrical insulating material, such as a ceramic, having opposed, flat top and bottom surfaces 26 and 28, and a central hole 30 therethrough between the top and bottom surfaces 26 and 28. The substrate 24 can be round, square or of any other desired shape. An inner annular termination film 32 of a conductive metal, is on the top surface 26 of the substrate 24 and extends around the edge of the hole 30. An outer annular termination film 34 of a conductive metal, is on the top surface 26 of the substrate 24 and extends around the outer edge of the substrate 24. The outer termination film 34 also extends across the outer edge 36 of the substrate 24 and over the bottom surface 28 of the substrate 24.

A resistance film 38 is on the top surface 26 of the substrate 24 and extends slightly over each of the inner and outer termination films 32 and 34. The resistance film 38 covers the entire portion of the top surface 26 of the substrate 24 between the terminal films 32 and 34. The resistance film 38 may be of any desired resistance material, such as a thin film of a suitable resistance metal or alloy, or a thick resistance film of a glass having disbursed therethrough particles of a metal or metal alloy. For power uses, the resistance film 38 is typically a 50 or 75 ohm resistor. However, it can be of any desired resistance value.

The resistor chip 22 is mounted on the first surface 14 of the base plate 12 with the bottom surface 28 of the substrate 24 being seated on the first surface 14 and with the hole 30 in the substrate 24 being aligned with the central hole 18 in the base plate 12. The resistor chip 22 is electrically and mechanically connected to the base plate 12 by a layer 40 of a solder of an electrically conductive metal or alloy. The solder layer 40 is between the portion of the outer termination film 34 which is on the bottom surface 28 of the substrate 24 and the first surface 14 of the base plate 12.

A flat metal terminal tab 42 extends through the central hole 18 in the base plate 12 and the hole 30 in the substrate 24. The terminal tab 42 has a bent end 44 which extends over the inner termination film 32 on the substrate 24. The end 44 of the termination tab 42 is electrically and mechanically secured to the inner termination film 32 by a layer 46 of a solder of a conductive metal.

A cover plate 48 of an electrically insulating material, such as a ceramic, extends over the top surface 26 of the substrate 24 and the resistor film 38. The cover plate 48 is of the same size and shape as the substrate 24 and has opposed flat top and bottom surfaces 50 and 52. An annular metal film 54 is on the bottom surface 52 of the cover plate 48 and extends along the outer edge of the cover plate 48. A circular metal film 56 is on the bottom surface 52 of the cover plate 48 at the center of the bottom surface 52. The cover plate 48 is mechanically secured to the chip resistor 22 by a solder layer 58 between the annular metal film 54 on the cover plate 48 and the outer termination film 34 on the substrate 24, and a solder layer 60 between the circular metal film 56 on the cover plate 48 and the inner termination film 32 on the substrate 24. Thus, the cover plate 48 is sealed across the resistance film 38 to protect the resistance film from the environment and from being physically damaged.

If desired, a cup shaped metal cover 62 may be placed over the chip resistor 22 and its cover plate 48 with the edge of the cover 62 being seated on and sealed to the first surface 14 of the base plate 12. The cover 62 provides additional protection to the resistor chip 22 against physical damage and damage from the environment. The cover 62 also provides protection against radiation.

Figure 4:
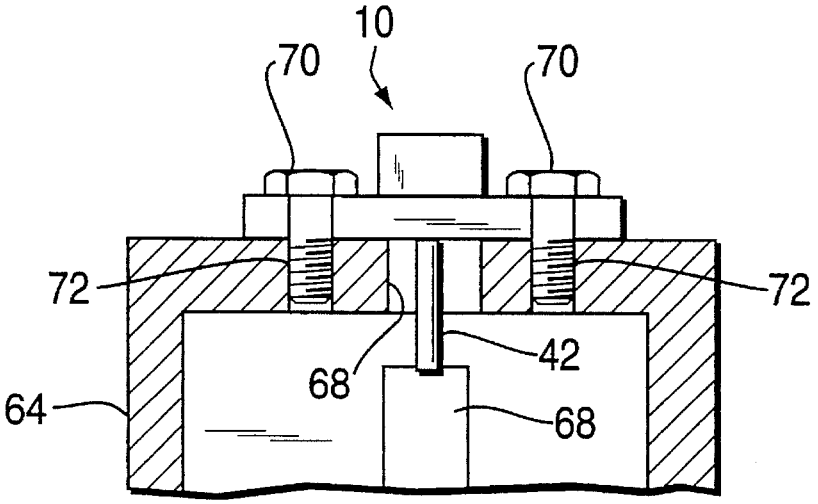
FIG. 4 is a partial sectional view showing the resistor of FIG. 1 mounted on a device-with which it is to be used.

In the resistor 10, the base plate 12 is electrically connected to one side of the resistance film 38 through the outer termination film 34 so as to serve as one termination of the resistor 10. The terminal tab 42 is electrically connected to the other end of the resistance film 38 through the inner termination film 32 so as to serve as the other termination of the resistor 10. As shown in FIG. 4, the resistor 10 is mounted on the housing 64 of a device with which it is to be used with the second surface 16 of the base plate 12 being seated on a surface of the housing 64 so as to be electrically connected to the housing 64. The terminal tab 42 extends through an opening 66 in the housing 64 and is electrically connected to a device 68 in the housing 64. The mounting plate 12 is mechanically connected to the housing 64 by screws or bolts 70 which extend through the holes 20 in the mounting plate 12 and are threaded into holes 72 in the housing.

Figure 5:
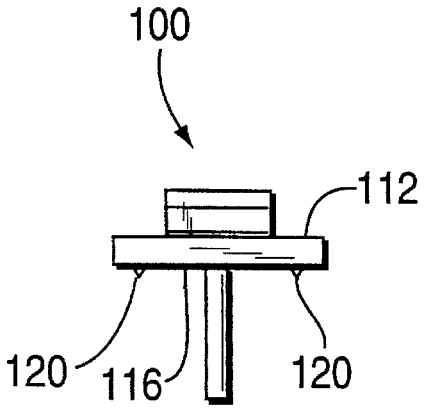
FIG. 5 is a side view of a modification of the low profile resistor of the present invention.
Figure 6:
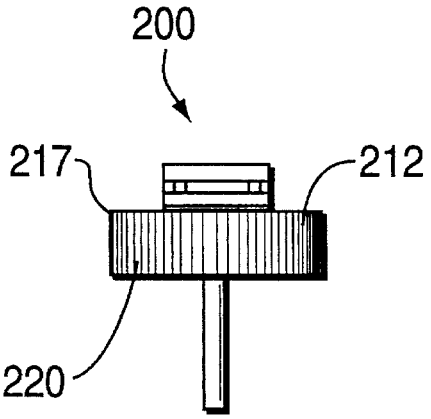
FIG. 6 is a side view of still another modification of the low profile resistor of the present invention.

Instead of securing the mounting plate 12 to the housing 64 by screws or bolts, it may be secured thereto by other means. Referring to FIG. 5, there is shown a resistor 100 in which the mounting plate 112 has small v-shaped projections 120 extending from its second surface 116. These projections 120 allow the mounting plate 112 to be welded to the body 64. Referring to FIG. 6, there is shown a resistor 200 in which the outer edge 217 of the mounting plate 212 is provided with serrations 220. The resistor 200 can be mounted on a housing 64 by inserting the mounting plate 212 into an opening in the housing 64 with the serrations 220 biting into the wall of the opening to fixedly secure the mounting plate 212 in the housing 64.

Thus, there is provided by the present invention a low profile load resistor which uses a chip resistor electrically and mechanically connected to a base plate and having a cover plate which protects the chip resistor from being damaged. The resistor is of relatively simple and rugged construction and has a low profile.

What is claimed is:

1. A load resistor comprising:

a base plate of an electrically conductive material having a pair of opposed surfaces and a hole therethrough;

a chip resistor mounted on one of the opposed surfaces of the base plate, the chip resistor comprising a substrate of an electrical insulating material having a pair of opposed surfaces and a hole therethrough, a resistance film on one of the surfaces of the substrate and having a pair of ends, a terminal tab electrically connected to one end of the resistance film and extending through the holes in the substrate and the base plate, and means electrically connecting the other end of the resistance film to the base plate.

2. The load resistor of claim 1 in which the chip resistor further comprises a first conductive termination film on said one surface of the substrate at one end of the resistance film, the terminal tab is electrically and mechanically connected to the first termination film, and a second conductive termination film on the one surface of the substrate electrically connected to the other end of the resistance film and to the base plate.

3. The load resistor of claim 2 in which the first termination film is along the edge of the hole in the substrate and the second termination film is along the peripheral edge of the substrate, the second termination film extends along the peripheral edge of the substrate and over the other surface of the substrate.

4. The load resistor of claim 3 in which the chip resistor is mounted on the surface of the base plate with the hole in the substrate being aligned with the hole in the base plate and with the portion of the second termination film which is on the other surface of the substrate being seated on the surface of the base plate.

5. The load resistor of claim 4 in which the terminal tab is secured to the first termination film by a conductive solder and the portion of the second termination film which is on the other surface of the substrate is secured to the base plate by a conductive solder.

6. The load resistor of claim 5 further comprising a cover plate of an electrical insulating material extending across the resistor film and mechanically connected to the substrate.

7. The load resistor of claim 6 in which the cover plate has spaced metal films on its surface facing the substrate and solder is between the metal films on the cover plate and the termination films on the substrate.

8. The load resistor of claim 7 further comprising a cup shaped cover extending over the chip resistor and secured to the base plate.

9. The load resistor of claim 1 including means on the base plate whereby the load resistor can be secured to a device with which it is to be used.

10. The load resistor of claim 9 in which the means for securing the mounting plate to a device comprises holes through the base plate through which screws or bolts can extend.

11. The load resistor of claim 9 in which the means for securing the mounting plate to a device comprises projections extending from the other surface of the base plate to allow the base plate to be welded to the device.

12. The load resistor of claim 9 in which the means for securing the mounting plate to a device comprises serrations around the peripheral edge of the base plate.

* * * * *